United States Patent [19]

Yellin

[11] 4,374,498

[45] Feb. 22, 1983

[54] SUPPORT AND JOINER MEANS FOR SHELVING

[76] Inventor: Bernard Yellin, 6 Oak Brook Club Dr., Oak Brook, Ill. 60521

[21] Appl. No.: 119,256

[22] Filed: Feb. 7, 1980

[51] Int. Cl.[3] ..... A47B 3/00; A47B 5/00

[52] U.S. Cl. ..... 108/114; 108/42; 108/152; 211/182; 248/250; 403/399

[58] Field of Search ..... 248/250, 235, 68 R; 211/90, 181, 182; 403/399, 398, 391, 395; 108/152, 47, 42, 46, 51, 114

[56] References Cited

U.S. PATENT DOCUMENTS

| | | | |
|---|---|---|---|
| 1,662,163 | 3/1928 | Norquist | 108/46 |
| 2,633,998 | 4/1953 | Derman | 108/152 X |
| 3,225,720 | 12/1965 | Maslow | 108/114 |
| 3,300,263 | 1/1967 | Action | 108/42 X |
| 3,355,134 | 11/1967 | Chesley | 248/250 |
| 3,598,064 | 8/1971 | Stempel | 248/249 |
| 4,004,526 | 1/1977 | King | 108/114 |

FOREIGN PATENT DOCUMENTS

| | | | |
|---|---|---|---|
| 640536 | 5/1962 | Canada | 108/152 |

*Primary Examiner*—James T. McCall

*Attorney, Agent, or Firm*—Arnstein, Gluck & Lehr

[57] ABSTRACT

A shelf including vertically spaced bars at the front thereof and horizontally spaced stringers connected to the bars and means for supporting and for joining shelves in end to end relation. The support and joining means consists of a simple sheet metal member and a bracket both of which are adapted to secure therebetween rods or stringers in clamping engagement.

10 Claims, 9 Drawing Figures

SUPPORT AND JOINER MEANS FOR SHELVING

BACKGROUND OF THE INVENTION

The present invention relates to novel support and joiner means for shelving of the spaced rod type having vertically spaced rods forming an open and downwardly projecting lip at the front of the shelf.

Prior art means for supporting and joining such shelves in end to end relation are commercially available but such means as exemplified in U.S. Pat. Nos. 3,598,064 and 3,765,634 are relatively expensive to manufacture because they comprise molded or die cast parts requiring the use of costly dies for their manufacture.

According to the invention a simple means is utilized both for supporting and for joining together shelve units in end to end relation. The tooling required for fabricating such means is extremely simple and the cost of fabrication is minimal resulting in substantial economies in production without any reduction in function or strength.

BRIEF DESCRIPTION OF THE DRAWINGS

Referring to FIG. 1, the shelf 10 shown therein includes two vertically spaced horizontal rods 11 and 12 at the front of the shelf, a rear horizontal rod 13 and an intermediate horizontal rod 14. All of the rods are parallel to each other. Rods 11,13 and 14 all lie in the same horizontal plane and rods 11 and 12 lie in the same vertical plane. All of the rods are tied together by a series of identical stringers 17 which extend between the front and rear of the shelf, each stringer including an integral depending portion 18 at the front of the shelf and all stringers being welded or otherwise suitably secured to the rods 11–14 at the points of intersection with the same.

The foregoing shelf structure is of conventional construction and is sold commercially in unit lengths of approximately 36 inches. If the width of the space in which the shelf is to be installed is less than a unit length, the rods 11–14 may be cut as with a hack saw to a desired length so as to fit the shelf within the space.

Figure 3:
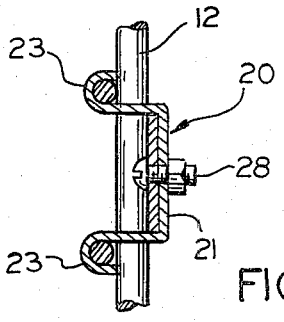
FIG. 3 is a cross-sectional view, on an enlarged scale, taken substantially on line 3—3 of FIG. 2.
Figure 4:
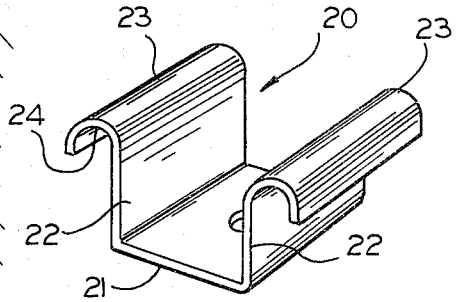
FIG. 4 is a perspective view of a support member, as shown in FIG. 2.

The shelf 10 is mounted on support means engaging the rods at the front and rear of the shelf. In accordance with my invention, I provide a support member 20 shaped like that illustrated in FIG. 4. The member 20 is stamped preferably from sheet metal and includes a channel shaped body having a bottom wall 21 and integral side walls 22,22, each having a reversely bent arcuate terminal portion 23. As is apparent by reference to FIGS. 2 and 3, the spacing between the vertical walls 22,22 is such that the member 20 fits snugly within the space between the front depending portions 18 of adjacent stringers 17, with each depending portion being snugly received in a respective recess 24 provided in a terminal portion 23. The dimensions of the support member 20 are such that the support member 20 while easily assembled with the shelf 10 will fit snugly within the space defined by the spaced rods 11 and 12 and will effectively engage adjacent depending front stringer portions 18 with substantially no play between the parts so as to provide a relatively rigid connection.

The support member 20 is intended to be utilized with a bracket arm 26 of any suitable configuration. The bracket arm 26 may be formed of sheet metal generally V-shaped in cross section, with the terminal portions 27 a and b being flat and being oppositely directed in angular relation to the main body portion of the bracket, as clearly shown in FIG. 2. The upper terminal portions 27*a* comprises a generally rectangular tongue 40 having lateral shoulders or projections 41.

Figure 1:
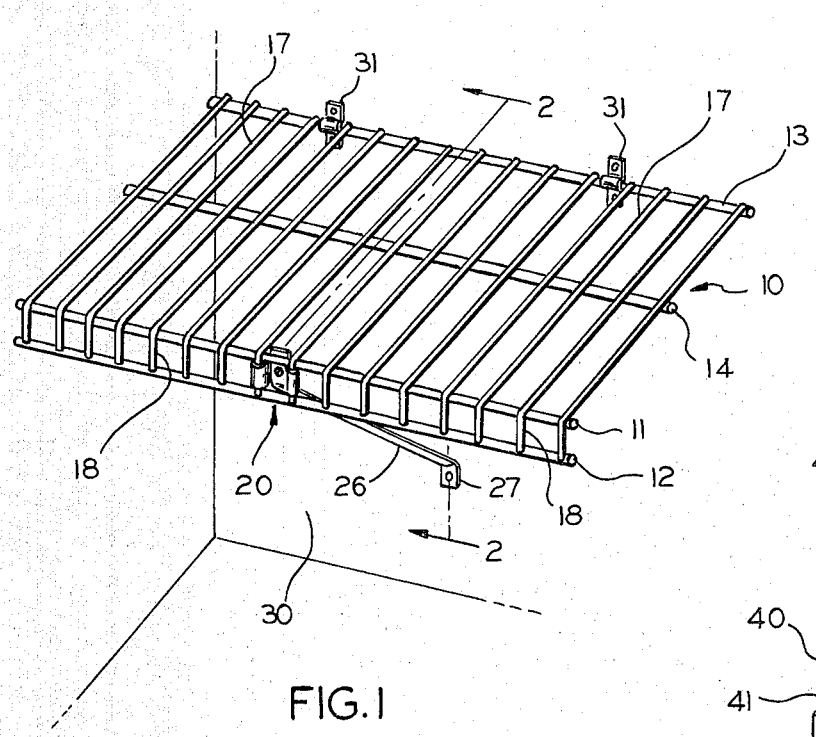
FIG. 1 is a perspective view of a shelf and mounting means, in accordance with one embodiment of the invention.
Figure 2:
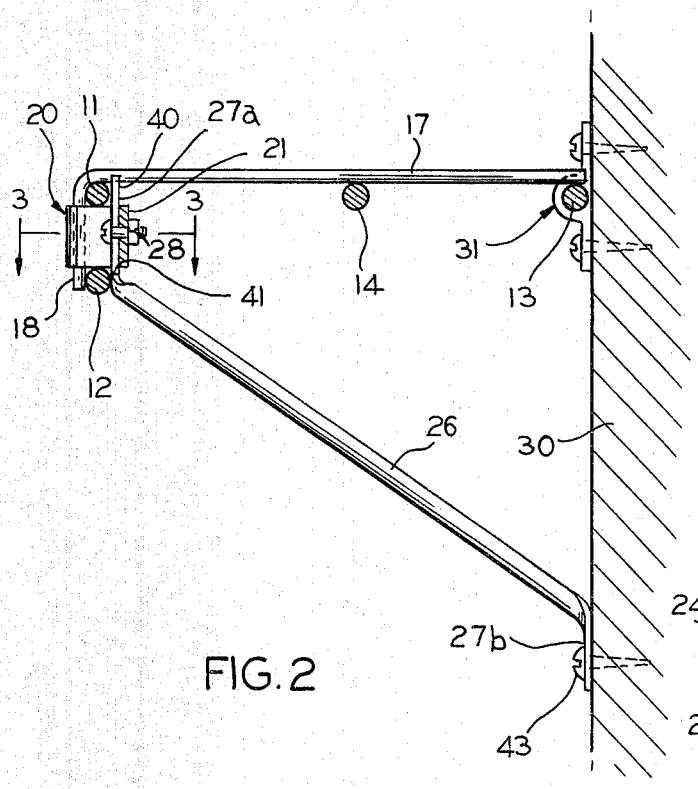
FIG. 2 is a cross-sectional view, on an enlarged scale, taken substantially on line 2—2 of FIG. 1.

In assembly, the support member 20 is inserted in a space delineated by the front rods 11 and 12 and adjacent depending front stringer portions 18 so that the stringer portions 18 are completely received in respective recesses 24. The tongue 40 is inserted in the space rearwardly of the rods 11 and 12 and forwardly of the wall 21 of the support member 20 to the point where the shoulders 41 engage the lower edge of wall 21. It will be noted, as illustrated in FIG. 2, that the terminal portion 27*a* bridges and engages the parallel rods 11 and 12 to provide effective securement of the parts. However, if additional securement is desired a bolt 28 may be passed through registering holes provided in the support member 20 and terminal portion 27*a* and tightened with a nut. The lower terminal portion 27*b* of the bracket arm 26 is secured to the wall 30, by a screw 43 as shown in FIGS. 1 and 2.

Figure 5:
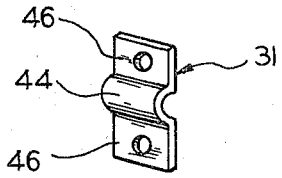
FIG. 5 is a perspective view of a rear support clip.
Figure 6:
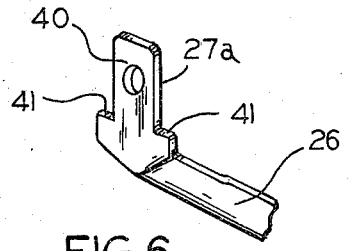
FIG. 6 is a fragmentary perspective view of the upper end of a bracket arm.

The shelf 10 may be supported at its rear by two or more suitable mounting clips 31 secured to the wall as with screws. The clip illustrated in FIG. 5 may be formed of plastic or metal and includes a median arcuate portion 44 and side wings 46.

Frequently two or more units of shelving 10 are required to be joined in end to end relationship. A joiner device to effect such joining is shown in U.S. Pat. No. 3,765,634. However, it will be apparent upon reference to the patent that the device comprises two complementary parts which are molded or die cast requiring the use of costly dies and tooling. On the other hand, the identical support member 20, hereinabove described, may be utilized.

Figure 7:
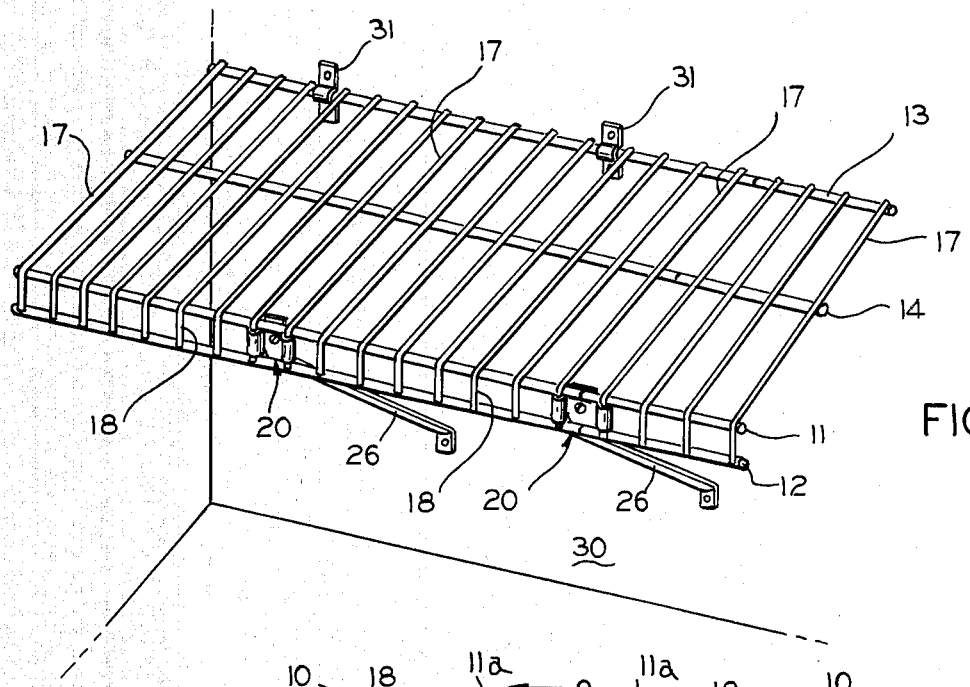
FIG. 7 is a perspective view, similar to FIG. 1, showing two shelf sections mounted on a wall and supported partially with a joiner member, in accordance with another embodiment of the invention.
Figure 8:
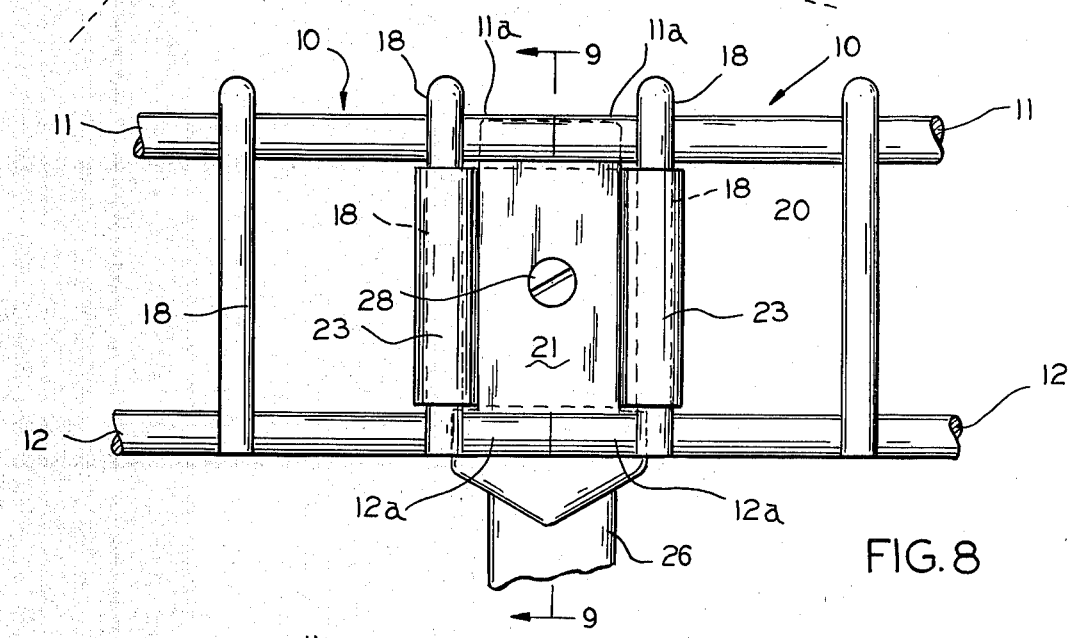
FIG. 8 is a front elevational view, on an enlarged scale, showing how the support member clamps around stringers of two shelf sections to be joined disposed in end to end relation.

Referring to FIGS. 7 and 8 the support member 20 is shown utilized as a joiner device for two shelf units 10 arranged in end to end abutting relationship.

As illustrated in FIG. 8, the end portions 11*a*, 12*a* of the rods 11 and 12, respectively, of each shelf unit 10 extend beyond the end stringer portions 18, the length of each such extension being about one-half of the distance between adjacent stringer portions 18 so that when two shelf sections are disposed in end to end abutment the spacing between the end stringer portions 18 of adjacent sections are substantially identical to the normal spacing of stringers of a shelf unit.

Figure 9:
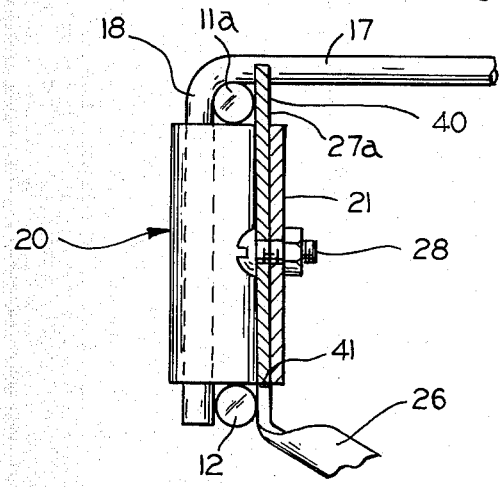
FIG. 9 is a cross-sectional view taken substantially on line 9—9 of FIG. 8.

In assembly, the support member 20 is applied, as illustrated in FIGS. 7–9, with the end depending portions 18,18 of the shelves 10,10, respectively, received in the recesses 24 of the member 20. The terminal portion 27*a* of a bracket arm 26 is applied exactly as hereinabove described and may be secured thereto as with a bolt 28 which when tightened effects a clamping of the rods 11 and 12 to the support member 20 and bracket arm 26. This secures the two adjacent shelf units 10 in accurate planar registration so that the continuity of the shelf is not interrupted. The lower end 27*b* of the bracket arm 26 is attached to the wall 30 as in the case of the first described embodiment, and the rear portions of the joined shelve units are supported by a clip 31, which bridges the abutting end portions of rods 13 and is attached to the wall 30.

It will be understood that the number of support members 20, as well as bracket arms 26, to be employed in the mounting of one or more shelf units will be dictated by the length of the shelf and the load to be carried thereon. Advantageously, support members 20 should be disposed at or near the ends of the shelf with one or more support members being disposed intermediate such ends.

It will be seen that the simple support means of my invention serves two functions, one for normal support, and two, for joining a pair of shelf sections in end to end coplanar relationship.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. A shelf and mounting structure including in combination first, second and third rods all in spaced and parallel relation with each other, said first and second rods both lying in a vertical plane and said second and third rods both lying in a horizontal plane, a plurality of stringers each extending transversely of said second and third rods and secured thereto in spaced relation, each said stringer having a forward integral depending portion secured to said first and second rods, a support member including a channel shaped body adapted to be received in a space delineated by said first and second rods and a pair of adjacent depending stringer portions, said channel shaped body having integral lateral terminal portions each engaging a forward surface of a respective depending stringer portion, and a bracket arm having upper and lower end portions with the upper end portion received in the channel of said body and adapted to bridge and engage the rear surfaces of said first and second rods, the lower end portion of said bracket arm being adapted for securement to a wall surface.

2. The invention as defined in claim 1 in which each side terminal portion of the support member has a recess to receive a respective depending stringer portion.

3. The invention as defined in claim 1 in which the support member is formed of sheet metal having a channel shaped body with each side wall of the body terminating in a reversely bent arcuate configuration forming a recess to receive a depending stringer portion.

4. The invention as defined in claim 1, including means engageable with the third rod and adapted for attachment to the wall surface for securing the rear of said shelf to said wall surface.

5. In combination, a pair of shelves and a support member for joining end to end two such shelves, in horizontal coplanar relation, each shelf having first, second and third rods all in spaced parallel relation with each other, said first and second rods lying in a vertical plane and said second and third rods both lying in a horizontal plane, a plurality of stringers each extending transversely of said second and third rods and secured thereto in spaced relation, each stringer having a forward integral depending portion secured to said first and second rods said support member including a channel shaped body having integral terminal portions, each forming a recess, said body being received in a space delineated by the respective end portions of said first and second rods in abutting relation and respective end depending stringer portions with said stringer portions being received in respective recesses, and a bracket arm having upper and lower end portions with the upper end portion being received in the channel of said body and bridging and engaging the rear surfaces of said first and second rods, the lower end portion of said bracket arm being adapted for securement to a wall surface.

6. The invention as defined in claim 5 including a clip bridging the abutting end portions of respective third rods and secured to the wall surface.

7. The invention as defined in claim 5 in which the upper end portion of the bracket arm includes lateral shoulders engageable with the lower edge of the channel shaped body.

8. The invention as defined in claim 1 in which the upper end portion of the bracket arm includes lateral shoulders engageable with the lower edge of the channel shaped body.

9. The invention as defined in claim 1 including screw means passing through said channel shaped body and the upper end portion of the bracket arm for securing the same in clamping engagement.

10. The invention as defined in claim 5 including screw means passing through said channel shaped body and the upper end portion of the bracket arm for securing the same in clamping engagement.

* * * * *